US011575985B2

(12) United States Patent
Azmi et al.

(10) Patent No.: US 11,575,985 B2
(45) Date of Patent: Feb. 7, 2023

(54) MASS LOADED EARBUD WITH VENT CHAMBER

(71) Applicant: Apple Inc., Cupertino, CA (US)

(72) Inventors: Yacine Azmi, San Jose, CA (US); Esge B. Andersen, Campbell, CA (US); Jonathan S. Aase, Avon, CO (US); Michael B. Howes, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/002,619

(22) Filed: Aug. 25, 2020

(65) Prior Publication Data

US 2020/0404410 A1 Dec. 24, 2020

Related U.S. Application Data

(63) Continuation of application No. 15/924,049, filed on Mar. 16, 2018, now Pat. No. 10,805,713, which is a (Continued)

(51) Int. Cl.
*H04R 1/10* (2006.01)
*H04R 1/28* (2006.01)

(52) U.S. Cl.
CPC ..... *H04R 1/1091* (2013.01); *H04R 1/1016* (2013.01); *H04R 1/2811* (2013.01); (Continued)

(58) Field of Classification Search
CPC .. H04R 1/2819; H04R 1/2826; H04R 1/2849; H04R 1/2857; H04R 1/1016; H04R 2201/10
See application file for complete search history.

(56) References Cited

U.S. PATENT DOCUMENTS 4,742,887 A * 5/1988 Yamagishi ..... H04R 1/2857 381/372
4,981,194 A * 1/1991 Kamon ..... H04R 1/1016 181/158

(Continued)

FOREIGN PATENT DOCUMENTS

CN 101431704 A 5/2009
CN 201937804 A 8/2011

(Continued)

OTHER PUBLICATIONS

Third Office Action for Chinese Application No. 201811086457.3 dated Jan. 6, 2021, 13 pages.

(Continued)

*Primary Examiner* — Ryan Robinson
(74) *Attorney, Agent, or Firm* — Womble Bond Dickinson (US) LLP

(57) ABSTRACT

Intra-concha earphones are disclosed. In an embodiment, an intra-concha earphone includes a housing having a rear space divided into a back volume, a bass duct, and a vent chamber between a driver and a rear wall. The vent chamber may be acoustically coupled with the back volume through both an acoustic port and the bass duct. Furthermore, the vent chamber may be acoustically coupled with a surrounding environment through a vent port, which may be a sole acoustic opening in the rear wall. Thus, sound emitted by the driver may propagate through the acoustic port and the bass duct to meet in the vent chamber before being discharged through the vent port to the surrounding environment. Other embodiments are also described and claimed.

20 Claims, 10 Drawing Sheets

Related U.S. Application Data continuation of application No. 15/403,392, filed on Jan. 11, 2017, now Pat. No. 9,942,648, which is a continuation of application No. 14/690,237, filed on Apr. 17, 2015, now Pat. No. 9,578,412.

(60) Provisional application No. 62/018,435, filed on Jun. 27, 2014.

(52) U.S. Cl.
CPC ..... *H04R 1/2823* (2013.01); *H04R 1/2826* (2013.01); *H04R 1/2849* (2013.01)

(56) References Cited

U.S. PATENT DOCUMENTS

| | | | | | |
|---|---|---|---|---|---|
| 5,327,507 | A * | 7/1994 | Suzuki | H04R 1/1016 | 381/345 |
| 5,949,896 | A * | 9/1999 | Nageno | H04R 1/2803 | 381/328 |
| 6,084,976 | A * | 7/2000 | Lin | H04R 1/1016 | 181/129 |
| 8,055,007 | B2 * | 11/2011 | Kim | H04R 1/1041 | 381/372 |
| 8,670,586 | B1 * | 3/2014 | Boyle | H04R 1/1008 | 381/189 |
| 8,755,550 | B2 * | 6/2014 | Monahan | H04R 1/1058 | 381/328 |
| 8,879,768 | B2 * | 11/2014 | Podoloff | H04R 1/1041 | 381/372 |
| 8,989,427 | B2 * | 3/2015 | Silvestri | H04R 1/1016 | 381/372 |
| 9,131,311 | B2 * | 9/2015 | Lumsden | A61F 11/08 | |
| 9,237,394 | B2 * | 1/2016 | Seo | H04R 1/1016 | |
| 9,245,515 | B2 * | 1/2016 | Llewellyn | G10K 11/17853 | |
| 9,258,663 | B2 * | 2/2016 | Aase | H04R 31/006 | |
| 9,319,767 | B2 * | 4/2016 | Sakaguchi | H04R 1/10 | |
| 9,363,594 | B2 * | 6/2016 | Azmi | H04R 1/2807 | |
| 9,451,350 | B2 * | 9/2016 | Ide | H04R 1/1041 | |
| 9,883,280 | B2 * | 1/2018 | Oosato | H04R 1/2857 | |
| 10,117,017 | B2 * | 10/2018 | Kuwahara | H04R 1/2857 | |
| 2008/0013773 | A1 * | 1/2008 | Yang | H04R 1/2826 | 381/379 |
| 2008/0267438 | A1 * | 10/2008 | Chen | H04R 1/2811 | 381/345 |
| 2012/0076341 | A1 * | 3/2012 | Ozawa | H04R 1/1016 | 381/380 |
| 2012/0155692 | A1 * | 6/2012 | Chen | H04R 1/1058 | 381/380 |
| 2012/0201406 | A1 * | 8/2012 | Yamaguchi | H04R 1/1016 | 381/309 |
| 2012/0275632 | A1 * | 11/2012 | Huang | H04R 1/2826 | 381/345 |
| 2012/0314882 | A1 * | 12/2012 | Sibbald | H04R 1/1075 | 29/896.2 |
| 2013/0028434 | A1 | 1/2013 | Sibbald et al. | | |
| 2013/0343593 | A1 * | 12/2013 | Howes | H04R 1/10 | 381/380 |
| 2013/0343594 | A1 * | 12/2013 | Howes | H04R 1/1016 | 381/380 |
| 2013/0343595 | A1 * | 12/2013 | Zorkendorfer | H04R 1/10 | 381/380 |
| 2015/0023510 | A1 * | 1/2015 | Shimizu | H04R 29/001 | 381/58 |
| 2015/0023515 | A1 * | 1/2015 | Reimert | H04R 1/1083 | 381/71.6 |
| 2015/0237437 | A1 * | 8/2015 | Hu | H04R 1/1016 | 381/338 |
| 2018/0020281 | A1 * | 1/2018 | Wurtz | A61F 11/08 | |

FOREIGN PATENT DOCUMENTS

| | | | | |
|---|---|---|---|---|
| CN | 102196330 | A | 9/2011 | |
| CN | 103517173 | A | 1/2014 | |
| CN | 105228039 | A | 1/2016 | |
| CN | 109218887 | | 1/2019 | |
| EP | 2677767 | A2 | 12/2013 | |
| GB | 2235852 | A * | 3/1991 | H04R 1/2819 |
| KR | 101194904 | B1 | 10/2012 | |
| WO | 2013192340 | A1 | 12/2013 | |

OTHER PUBLICATIONS

Third Office Action for Chinese Application No. 201811085882.0 dated Feb. 2, 2021, 6 pages.

Chinese Notice of Allowance from related Chinese Application No. 201811085882.0 dated May 8, 2021 (4 pages).

Chinese Notice of Allowance from related Chinese Application No. 201811086457.3 dated May 8, 2021 (2 pages).

* cited by examiner

MASS LOADED EARBUD WITH VENT CHAMBER

This application is a continuation of co-pending U.S. application Ser. No. 15/924,049 filed Mar. 16, 2018, which is a continuation of U.S. application Ser. No. 15/403,392, filed Jan. 11, 2017, now U.S. Pat. No. 9,942,648, issued Apr. 10, 2018, which is a continuation of U.S. application Ser. No. 14/690,237 filed Apr. 17, 2015, now U.S. Pat. No. 9,578,412, issued Feb. 21, 2017, which claims the benefit of U.S. Provisional Patent Application No. 62/018,435, filed Jun. 27, 2014, and this application hereby incorporates those applications by reference.

BACKGROUND

Field

Embodiments related to headphones are disclosed. More particularly, an embodiment related to an intra-concha earphone having a rear space divided into a back volume, a bass duct having an acoustic mass, and a vent chamber, is disclosed. The vent chamber may be acoustically coupled with the back volume and the bass duct and may be ported to a surrounding environment through a single rear port, in an embodiment.

Background Information

Intra-concha earphones, also known as earbuds, are headphones that are placed in the outer ear. Intra-concha earphones may face an ear canal, but are typically not inserted into the ear canal, during use. Since intra-concha earphones do not generally seal within the ear canal, sound can leak from the earphone and not reach the ear canal. Furthermore, sound from a surrounding environment may travel around the earphone into the ear canal, further degrading acoustic performance. Since sound leakage may depend on the anatomy of the user's ear, acoustic performance of intra-concha earphones may be inconsistent across all use cases.

SUMMARY

Embodiments of intra-concha earphones are disclosed. In an embodiment, an intra-concha earphone includes a housing holding a driver that converts an electrical audio signal into a sound. The housing may have a rear wall behind the driver and a rear space may be defined between the driver and the rear wall. A chamber partition may be located in the rear space, and may divide the rear space into several spaces, including a back volume behind the driver, a vent chamber between the chamber partition and the rear wall, and a bass duct. The chamber partition may also define one or more ports or apertures, such as an acoustic port that acoustically couples the back volume with the vent chamber, and a bass aperture from which the bass duct extends at the back volume to a duct port at the vent chamber. The rear wall may include a vent port such that the vent chamber is acoustically coupled with a surrounding environment through the vent port. Furthermore, the vent port may be the only acoustic opening in the rear wall of the housing. Thus, a first portion of a sound emitted by the driver may propagate through the acoustic port and a second portion of the sound may propagate through the bass duct such that the sound portions meet in the vent chamber before exiting the housing through the vent port.

The chamber partition may include a front surface facing the driver and a back surface facing the rear wall. The front surface may at least partially define the back chamber and the back surface may at least partially define the vent chamber. Furthermore, a duct contour in the back surface may define the bass duct between the chamber partition and the rear wall. In an embodiment, the duct contour follows a curvilinear path over the back surface between the bass aperture and the bass port. The bass port may be located across the vent chamber from the acoustic port, e.g., the ports may be separated by less than 1 mm such that sound passing through acoustic port and duct port enter vent chamber at approximately the same location.

In an embodiment, one or more of the ports or apertures in the earphone are covered by an acoustic material. For example, the acoustic port, the duct port, and/or the vent port may be covered by a mesh material. Each port, covered or uncovered, may exhibit an acoustic impedance based on the port geometry, covering material, etc. In an embodiment, the acoustic port has an acoustic impedance that is higher than the acoustic impedances of both the duct port and the vent port. For example, the acoustic port may have an acoustic impedance that is at least 25 times the acoustic impedance of the vent port. The acoustic impedance of the vent port may be lower than about 10 Rayl so as to not substantially impede sound propagation toward the surrounding environment. However, the vent port, or any other port or aperture, may have a non-zero acoustic impedance, relative to open air, as a result of a protective shroud that covers the port and reduces the likelihood that foreign material will intrude into the earphone from the surrounding environment.

In addition to providing an acoustic network within the earphone, the one or more chambers formed by the chamber partition may also hold components used for acoustic control. For example, a microphone may be located in the vent chamber to sense sounds from the surrounding environment. The microphone may therefore provide a signal that can be processed to implement active noise control by the earphone.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
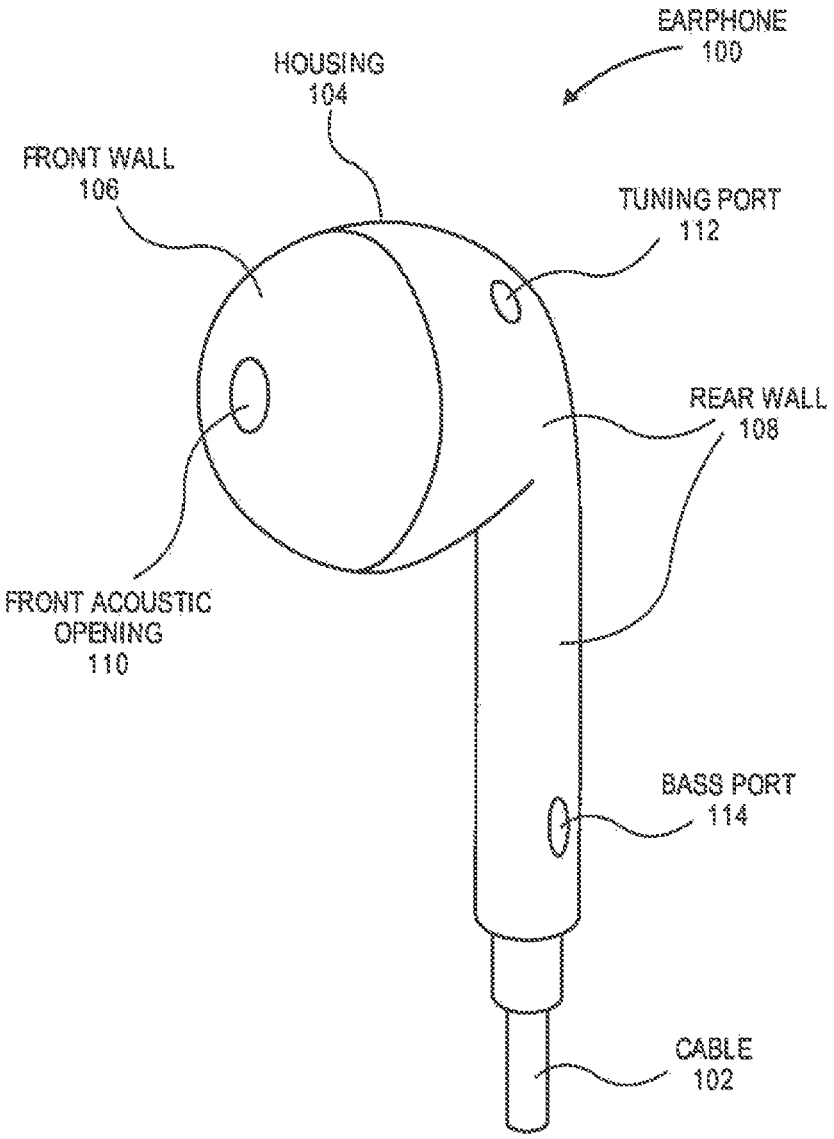
FIG. 1 is a perspective view of an earphone having multiple acoustic openings in a rear portion of a housing in accordance with an embodiment of the invention.

Embodiments of the invention describe headphones for use in playing externally generated audio signals received from an external audio source. However, while some embodiments are described with specific regard to intra-concha earphones, the embodiments are not so limited, and certain embodiments may also be applicable to other uses. For example, one or more of the embodiments described below may be integrated within other devices or apparatuses that direct sound into the ear, such as intra-canal earphones that typically seal against the ear canal.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment", or the like, means that a particular feature, structure, configuration, or characteristic described is included in at least one embodiment. Thus, the appearance of the phrase "one embodiment," "an embodiment", or the like, in various places throughout this specification are not necessarily referring to the same embodiment. Furthermore, the particular features, structures, configurations, or characteristics may be combined in any suitable manner in one or more embodiments.

In an aspect, an intra-concha earphone includes a housing having a rear space divided into a back volume, a bass duct, and a vent chamber between a driver and a rear wall. The vent chamber may be acoustically coupled with the back volume through both an acoustic port and the bass duct. Furthermore, the vent chamber may be acoustically coupled with a surrounding environment through a vent port. Sound emitted by the driver may propagate through the acoustic port and the bass duct to meet in the vent chamber before being discharged through the same vent port to the surrounding environment. Because the vent port may be a sole opening in the rear wall, e.g., a single externally visible opening in the rear wall, the likelihood that external materials will intrude into the earphone may be reduced.

In an aspect, a chamber partition in the housing may define the back volume, the bass duct, and the vent chamber geometry. Thus, the chamber partition may be sized and configured to control an acoustic mass of the volumes within the earphone. Furthermore, the chamber partition may define the acoustic pathways that acoustically couple the driver with the surrounding environment. The acoustic pathways may include the acoustic port between the back volume and the vent chamber, a bass aperture between the back volume and the bass duct, a bass port between the bass duct and the vent chamber, or the vent port exiting to the surrounding environment. Thus, the chamber partition may be sized and configured to control an acoustic impedance of the respective acoustic pathways. The acoustic impedances of the ports and apertures within earphone may be altered by one or more acoustic materials, such as meshes, covering the ports. Thus, the chamber partition and other acoustic elements of the earphone may be configured to achieve a desired resonance of a driver and to tune a frequency response and bass response of the earphone to a desired level. Because the desired acoustic performance can be achieved with an acoustic network that fits within the rear space of the earphone, bass tubes radiating from the rear space may be eliminated, and the earphone can be packaged compactly.

Referring to FIG. 1, a perspective view of an earphone having multiple acoustic openings in a rear portion of a housing is shown in accordance with an embodiment of the invention. An earphone 100 may be configured to connect to an electronic device, such as a portable media player or another device capable of playing audio, video, or other media. For example, earphone 100 may include an audio jack or other electrical connector that electrically connects the electronic device with a cable 102. Accordingly, an externally generated audio signal may be delivered through cable 102 to a driver within a housing 104 of earphone 100. The driver may convert the electrical audio signal into a sound. In an alternative embodiment, the earphone 100 incorporates a wireless interface to receive the externally generated audio signal via a wireless connection with an external amplifier.

Housing 104 may be sized and configured to rest within a concha of an ear without sealing against an ear canal of the ear. Accordingly, housing 104 may include a front wall 106 configured to face the ear canal and a rear wall 108 configured to approximate the contour of the concha such that the earphone 100 resists dislodgment from the ear. When resting within the concha, the driver in the housing 104 may emit sound forward through a front acoustic opening 110 in front wall 106 and into the ear canal. In addition to emitting sound in a forward direction through front acoustic opening 110, sound generated by the driver may be emitted in a rearward direction through a tuning port 112 and a bass port 114.

Figure 2:
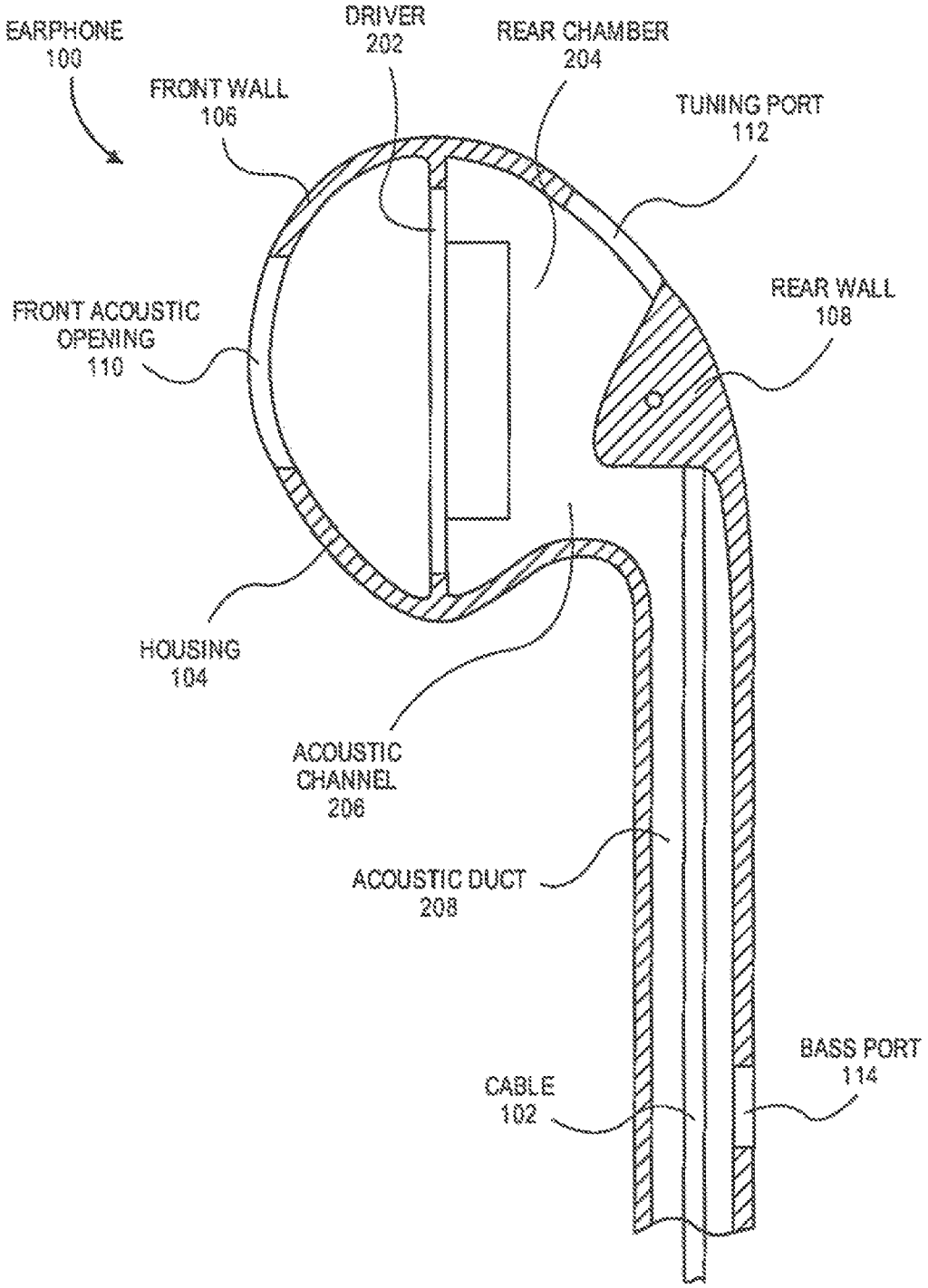
FIG. 2 is a cross-sectional view of an earphone having multiple acoustic openings in a rear portion of a housing in accordance with an embodiment of the invention.

Referring to FIG. 2, a cross-sectional view of an earphone having multiple acoustic openings in a rear portion of a housing is shown in accordance with an embodiment of the invention. Front wall 106 may be defined as a portion of housing 104 extending forward from a driver 202 and rear wall 108 may be defined as a portion of housing 104 extending behind driver 202. For example, a transverse plane may pass orthogonal to a central axis of driver 202, and front wall 106 may be the portion of housing 104 axially in front of the transverse plane while rear wall 108 may be the portion of housing 104 axially behind the traverse plane. A rear chamber 204 may be located within housing 104 between driver 202 and rear wall 108. Thus, sound emitted from driver 202 in a rearward direction may be directed toward tuning port 112 formed through rear wall 108 at rear chamber 204, as well as toward an acoustic channel 206 leading from rear chamber 204 into an acoustic duct 208. Sound directed toward acoustic channel 206 may propagate through acoustic duct 208 to bass port 114.

Figure 3:
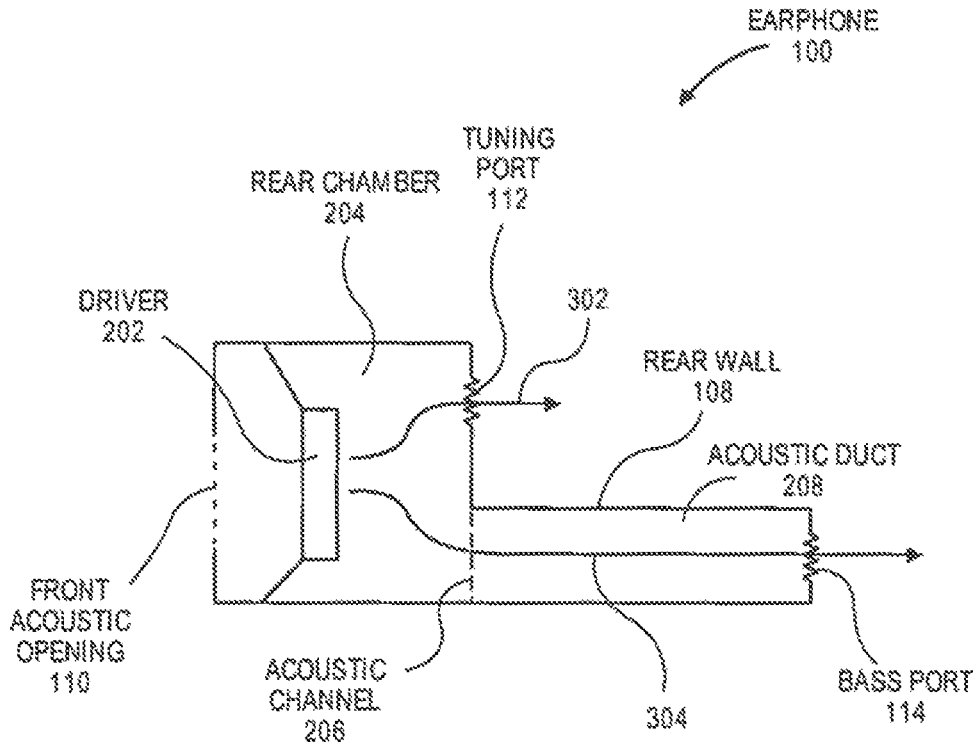
FIG. 3 is a schematic view of an earphone having multiple acoustic openings in a rear portion of a housing in accordance with an embodiment of the invention.

Referring to FIG. 3, a schematic view of an earphone having multiple acoustic openings in a rear portion of a housing is shown in accordance with an embodiment of the invention. Sound emitted by driver 202 into rear chamber 204 may include a first sound portion 302 directed toward tuning port 112 and a second sound portion 304 directed toward acoustic channel 206. More particularly, first sound portion 302 is output to the surrounding environment through a first location of rear wall 108, i.e., tuning port 112, and second sound portion 304 propagates through acoustic duct 208 to be output to the surrounding environment through a second location of rear wall 108, i.e., bass port 114. First sound portion 302 and second sound portion 304 do not commingle within earphone 100 after leaving rear chamber 204 or before being discharged from housing 104 into the surrounding environment. Accordingly, rear wall 108 includes at least two externally visible openings corresponding to tuning port 112 and bass port 114, and therefore, external materials such as dust, debris, and other particles may enter earphone 100 through rear wall 108 at multiple locations.

Having described a structure and acoustic function of an earphone 100 having multiple acoustic openings in rear wall 108, the description below shall focus on embodiments of an earphone 100 having a vent chamber that ports to the surrounding environment through a single acoustic opening in a rear housing wall. It will nonetheless be appreciated that the embodiments of the invention described herein are not mutually exclusive, and thus, features of an earphone 100 having multiple acoustic opening in rear wall 108 may be combined with features of an earphone 100 having a single acoustic opening in a rear housing wall within the scope of the invention.

Figure 4:
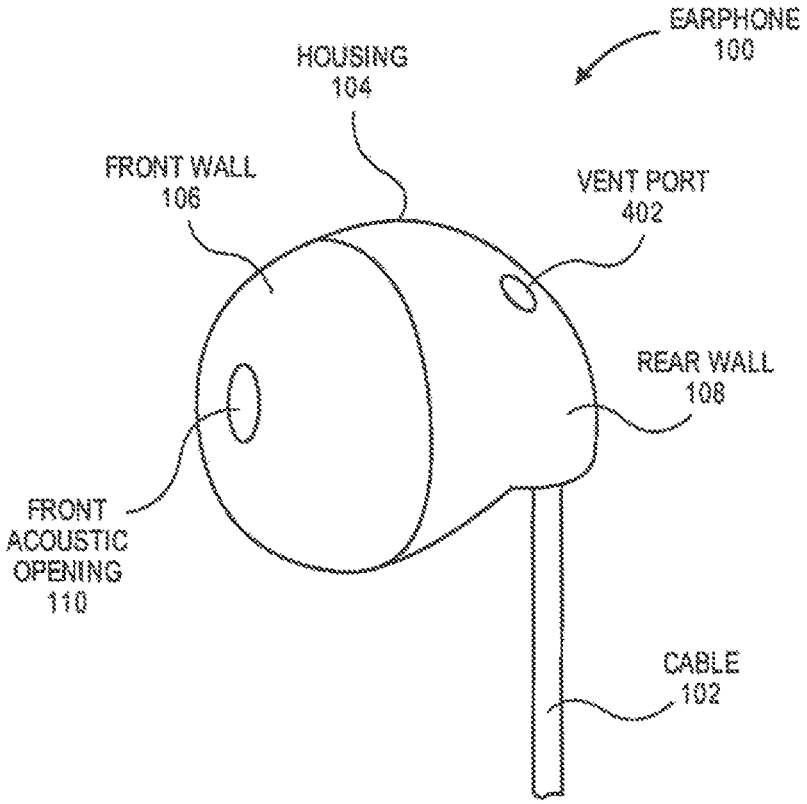
FIG. 4 is a perspective view of an earphone having a single acoustic opening in a rear portion of a housing in accordance with an embodiment of the invention.

Referring to FIG. 4, a perspective view of an earphone having a single acoustic opening in a rear portion of a housing is shown in accordance with an embodiment of the description. Earphone 100 may be configured to receive an externally generated audio signal through cable 102 and convert the electrical audio signal into a sound that is played by a driver 202 within housing 104 through front acoustic opening 110 in front wall 106. Earphone 100 may have housing 104 that is sized and configured to rest within a concha of an ear. Accordingly, the sound may be played through the front acoustic opening 110 into an ear during use.

Similar to the embodiment described above with respect to FIGS. 1 and 2, driver 202 may also emit sound in a rearward direction toward rear wall 108. However, in an embodiment, an acoustic mass of acoustic duct 208 may be integrated within rear wall 108 behind driver 202, along with rear chamber 204. More particularly, the sound may be routed through an acoustic network axially behind the driver 202 and within the rear wall 108. A comparison of the earphone 100 embodiments shown in FIGS. 1 and 4 indicates that incorporating the acoustic network within the rear wall 108 in this manner may allow for a more compact earphone 100.

Referring now to FIG. 4, the sound emitted rearward by driver 202 may be discharged from housing 104 through a vent port 402 in rear wall 108. More particularly, rear wall 108 may include an externally visible acoustic opening through which sound emitted rearward by driver 202 communicates with the surrounding environment. That is, multiple acoustic channels may be routed to meet within housing 104 such that a plurality of vent ports may be unified to vent from housing 104 at a single visual location. Thus, in an embodiment, vent port 402 provides the sole acoustic opening in rear wall 108.

Figure 5:
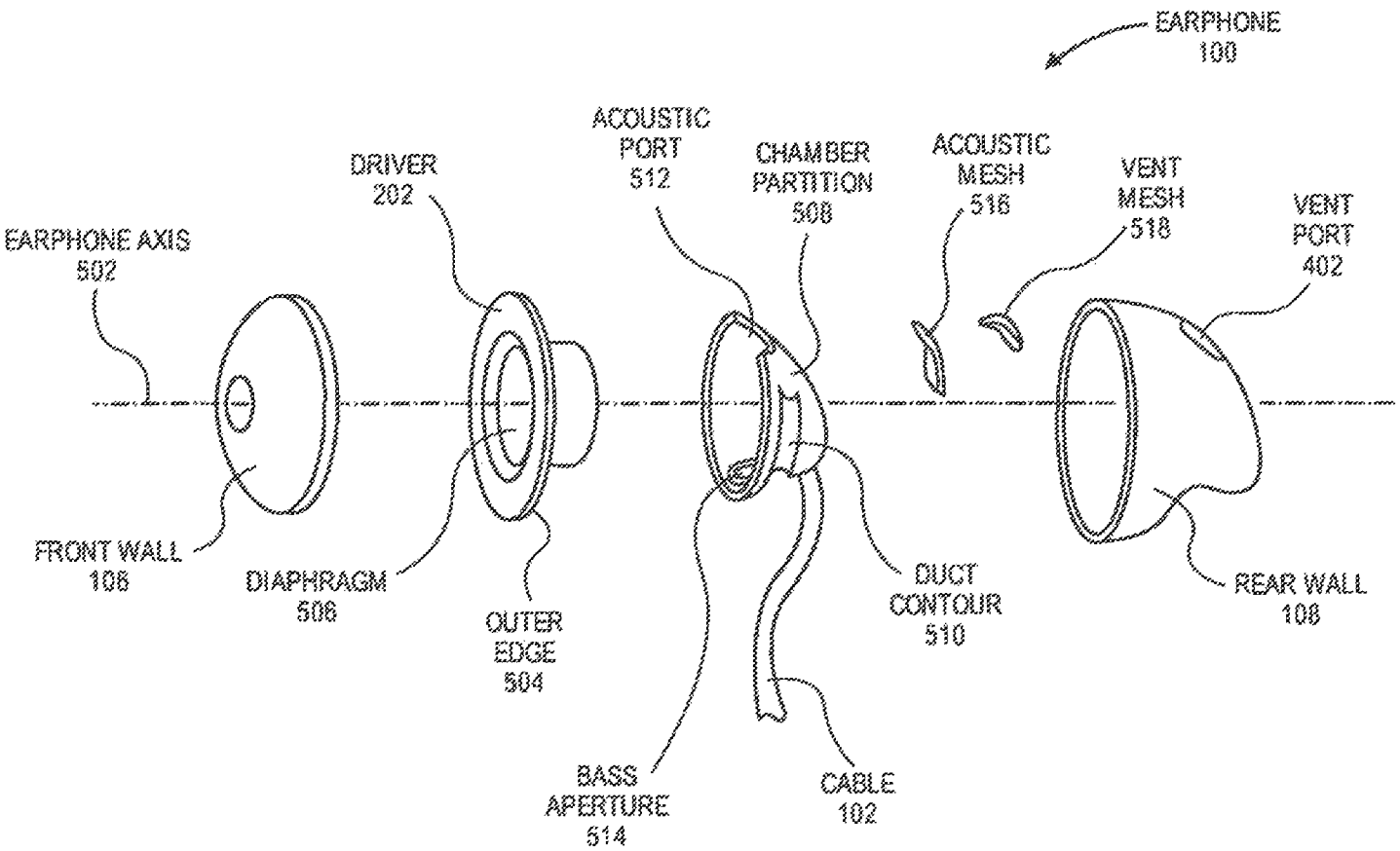
FIG. 5 is an exploded view of an earphone having a single acoustic opening in a rear portion of a housing in accordance with an embodiment of the invention.

Referring to FIG. 5, an exploded view of an earphone having a single acoustic opening in a rear portion of a housing is shown in accordance with an embodiment of the invention. The various components of earphone 100 may be aligned along an earphone axis 502. Earphone axis 502 may be defined as the axis passing through a center of driver 202. That is, an outer edge 504 of driver 202 may be axially aligned with earphone axis 502. For example, in an embodiment, outer edge 504 is circular and is centered about earphone axis 502. Furthermore, outer edge 504 may be concentric with a diaphragm 506 of driver 202 such that sound emitted by the diaphragm 506 in a forward or a rearward direction initially propagates along earphone axis 502. Front wall 106 of housing 104 may be disposed forward of driver 202 along earphone axis 502 and rear wall 108 of housing 104 may be disposed rearward of driver 202 along earphone axis 502.

In an embodiment, one or more components may be located within housing 104 between driver 202 and rear wall 108 to divide a volume of space within housing 104 into multiple chambers or volumes. For example, a chamber partition 508 may be located between driver 202 and rear wall 108. Chamber partition 508 may have a shape that conforms and/or seals against housing 104 in such a way that several volumes or chambers are defined between the surface of chamber partition 508 and the surface of driver 202 or rear wall 108. For example, a chamber may be defined between driver 202 and a front surface of chamber partition 508. A back surface of chamber partition 508 may have a duct contour 510, e.g., a recessed profile, extending along a path to form a groove or channel along the back surface. The duct contour 510 may mate with an inner surface of rear wall 108 to form an acoustic channel having an acoustic mass of air, e.g., a bass tube. The several volumes may further be placed in fluid communication with each other, i.e., acoustically coupled with one another, through various ports, such as acoustic port 512 or bass aperture 514. Because several independent volumes may be defined by one or more chamber partition 508, frequency response and bass response of the acoustic network may be tuned by altering the shape of the partitions. Furthermore, since the individual volumes may be acoustically coupled through one or more port or aperture, the frequency response and bass response of the acoustic network may be altered by controlling acoustic impedance of the ports and apertures. Accordingly, mesh elements may cover the ports to alter their acoustic impedance. For example, an acoustic mesh 516 may cover acoustic port 512 and a vent mesh 518 may cover vent port 402. The meshes may include edges that mate with corresponding edges of the ports such that cross-sectional areas of the ports are filled to cover the ports.

Figure 6:
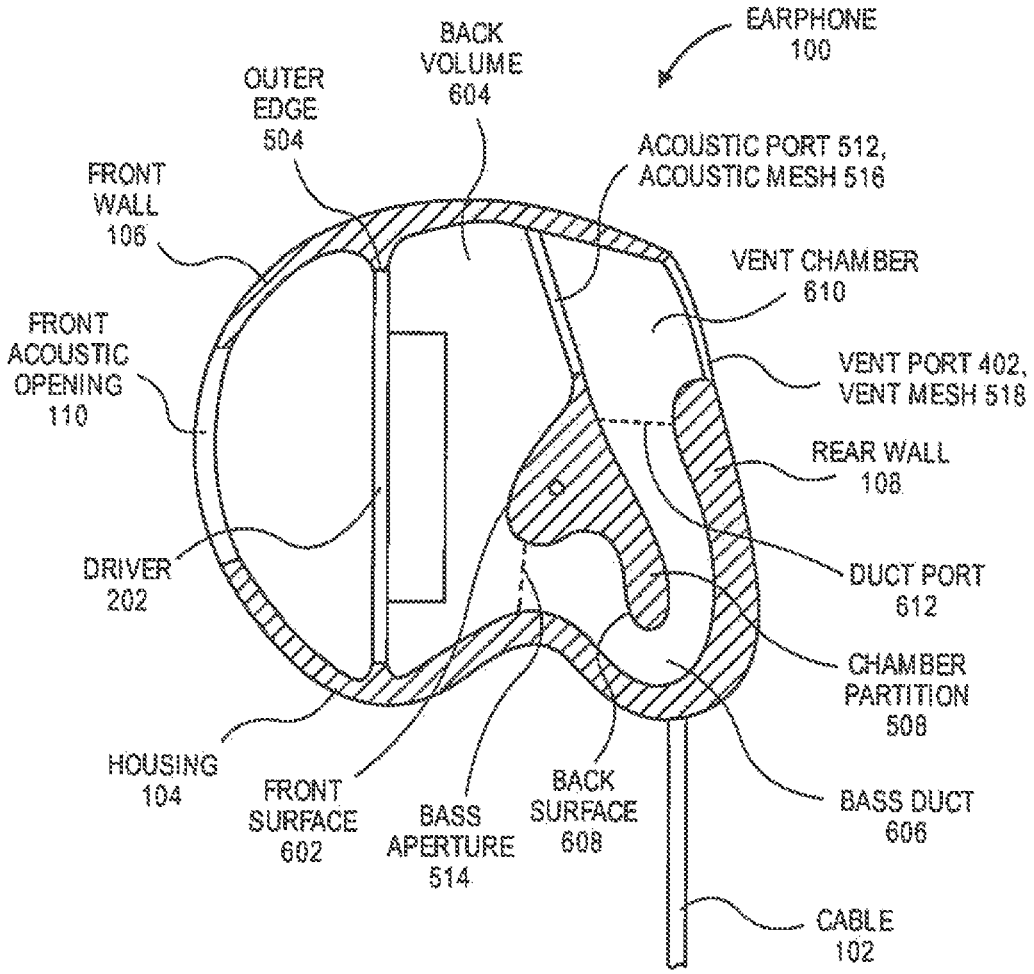
FIG. 6 is a cross-sectional view of an earphone having a single acoustic opening in a rear portion of a housing in accordance with an embodiment of the invention.

Referring to FIG. 6, a cross-sectional view of an earphone having a single acoustic opening in a rear portion of a housing is shown in accordance with an embodiment of the invention. A rear space may include the entire volume between driver 202 and rear wall 108 of earphone 100. Thus, the rear space may be defined by the space surrounded by the apposing surfaces of driver 202 and rear wall 108. Housing 104 may support driver 202 around outer edge 504 such that a front face of driver 202 faces front wall 106 and a rear face of driver 202 faces the rear space. Accordingly, rear wall 108 of housing 104 may enclose the rear space behind the driver 202. Thus, as discussed above, as externally generated audio signals are delivered to driver 202 through cable 102 (which may extend through the rear space to attach to driver 202) the electrical signals may be converted by driver 202 to sound that is emitted forward to front acoustic opening 110 and rearward into the rear space.

In an embodiment, chamber partition 508 resides in the rear space and includes a shape that divides the rear space into one or more volumes. In an embodiment, chamber partition 508 may be assembled from multiple components and/or there may be multiple chamber partitions 508 that subdivide the rear space, however for ease of understanding, chamber partition 508 is described below as essentially including a single body with surface geometry to create an acoustic network of chambers and ducts within the rear space that are acoustically coupled through one or more ports and/or apertures.

Chamber partition 508 may include a front surface 602 facing driver 202. The front surface 602 may define a back volume 604 behind driver 202 and between driver 202 and chamber partition 508. Back volume 604 may be a sub-volume of the rear space. Back volume 604 may essentially include a cavity with a volumetric geometry that depends on the surfaces of driver 202, rear wall 108, and chamber partition 508. That is, those surfaces may surround, and therefore define, back volume 604. For example, chamber partition 508 may have a concave front surface 602 defining a corresponding convex portion of back volume 604. That is, the spatial envelope of back volume 604 may be the negative space conforming to front surface 602. The size and shape of back volume 604, as defined by the surfaces surrounding the volume, can be important to the overall acoustic performance of earphone 100. More particularly, the back volume 604 cavity may tune a frequency response of earphone 100. In particular, the size of back volume 604 formed between driver 202, rear wall 108, and chamber partition 508 can determine the resonance of earphone 100 within, for example, a frequency range of about 2 kHz to about 3 kHz, i.e., open ear gain. The ear canal typically acts like a resonator and has a particular resonance frequency when open and a different resonance frequency when closed. The acoustic response at the ear drum when the ear canal is open is referred to as the open ear gain. A resonance frequency of about 2 kHz to 3 kHz is typically preferred by users. Back volume 604 may be shaped to tune the resonance of earphone 100 to a frequency within this range. More specifically, when rear wall 108 or chamber partition 508 are shaped to reduce back volume 604, the open ear gain may increase in frequency. As an example, back volume 604 may be reduced by decreasing the radius of rear wall 108 laterally surrounding back volume 604 about earphone axis 502. Alternatively, back volume 604 may be reduced by decreasing the distance between chamber partition 508 and driver 202 along earphone axis 502. Conversely, when rear wall 108 or chamber partition 508 are shaped to increase back volume 604, the open ear gain may decrease in frequency. As an example, back volume 604 may be increased by increasing the radius of rear wall 108 laterally surrounding back volume 604 about earphone axis 502. Alternatively, back volume 604 may be increased by increasing the distance between chamber partition 508 and driver 202 along earphone axis 502. Accordingly, back volume 604 geometry may be adjusted to tune the resonance and acoustic performance of earphone 100.

Chamber partition 508 may further define one or more ports or apertures connecting back volume 604 with one or more additional volumes located behind chamber partition 508 from back volume 604. The additional volumes may be other sub-volumes of the rear space. The rear space within housing 104 may be subdivided to include a bass duct 606 acoustically coupled with back volume 604 through a bass aperture 514. In an embodiment, bass aperture 514 may be a hole formed through chamber partition 508 (see FIG. 5). However, bass aperture 514 may also be a port defined between an outer edge of chamber partition 508 and an inner surface of rear wall 108 (similar to acoustic port 512 shown in FIG. 5). Thus, bass aperture 514 may provide a channel connecting back volume 604 with bass duct 606.

Similar to back volume 604, bass duct 606 may be defined as a volume of space between a back surface 608 of chamber partition 508 and an inner surface of rear wall 108. Bass duct 606 may be a sub-volume of the rear space. That is, bass duct 606 may essentially include a cavity with a volumetric geometry that depends on the surfaces of rear wall 108 and chamber partition 508 surrounding bass duct 606. For example, chamber partition 508 may define a duct structure extending away from back volume 604 at bass aperture 514. In addition to defining a duct, chamber partition 508 may also define a duct port 612 at an end of bass duct 606. For example, duct port 612 may be defined between back surface 608 and rear wall 108, which may join to create a port shape. The surfaces defining the cavity of bass duct 606 may be sized and shaped to tune a bass response of driver 202. Just as chamber partition 508 dimensions can be altered to control back volume 604 geometry and hence earphone 100 resonance, chamber partition 508 dimensions can be altered to control bass duct 606 geometry and hence bass response of earphone 100. In an embodiment, bass response may be controlled to a frequency of less than 1 kHz by shaping bass duct 606 to contain a volume of air that acts as a corresponding acoustic mass.

The rear space within housing 104 may further be subdivided to include a vent chamber 610 between chamber partition 508 and rear wall 108. That is, vent chamber 610 may essentially include a cavity with a volumetric geometry that depends on the surfaces of chamber partition 508 and rear wall 108. Vent chamber 610 may be a sub-volume of the rear space. Vent chamber 610 may be acoustically coupled with back volume 604 through both acoustic port 512 and bass duct 606. More particularly, back volume 604 that tunes the earphone 100 resonance may port into vent chamber 610 through acoustic port 512, while bass duct 606 that tunes the bass response of earphone 100 may port into vent chamber 610 through duct port 612. Accordingly, sound transmitted through back volume 604 and bass duct 606 may enter, meet, or mix in vent chamber 610 before venting from housing 104.

Optionally, vent chamber 610 may be axially behind acoustic port 512 in a direction of earphone axis 502. Similarly, vent chamber 610 may be axially behind driver 202 in the direction of earphone axis 502. For example, a space behind outer edge 504 may form a spatial envelope of a cylinder in the direction of earphone axis 502. Vent chamber 610 may be encompassed by the spatial envelope such that the entire chamber volume is directly behind driver 202. Thus, vent chamber 610 may not add additional lateral dimensions to earphone 100 over the lateral dimension that is already formed by outer edge 504 of driver 202.

Transmission of sound from back volume 604 into vent chamber 610 may depend on the geometry of the various interconnected ports and apertures. For example, acoustic impedance of acoustic port 512 may be varied by changing the size or length of acoustic port 512 between back volume 604 and vent chamber 610. These dimensions may be varied by adjusting the shapes of chamber partition 508 and rear wall 108 surfaces that define acoustic port 512 to achieve the desired acoustic impedance. In addition to modifying chamber partition 508 and rear wall 108 geometries, acoustic materials may be placed over one or more of the various ports or apertures.

In an embodiment, an acoustic mesh 516 is disposed over or within acoustic port 512 to modify the acoustic performance of earphone 100. For example, acoustic mesh 516 may cover acoustic port 512 to alter acoustic impedance of acoustic port 512. In an embodiment, acoustic mesh 516 is formed of an acoustic material that is acoustically engineered to provide a defined and intentional acoustic resistance or filtering effect. For example, acoustic mesh 516 may be a mesh or foam material that is manufactured to filter certain sound pressure waves emitted by driver 202 toward acoustic port 512. Alternatively, acoustic mesh 516 may be acoustically transparent so as to not substantially interfere with sound transmission through acoustic port 512. In either case, acoustic mesh 516 may provide a protective barrier against the unwanted entry of external materials, such as dust, water, or other particles, into back volume 604 from vent chamber 610.

Optionally, an acoustic material may be located over or within duct port 612 or bass aperture 514 to modify the acoustic performance of earphone 100, or to protect against the unwanted intrusion of external materials into bass duct 606. For example, a duct mesh (not shown) may cover duct port 612 to alter acoustic impedance of bass duct 606. In an embodiment, duct mesh is formed of an acoustic material that is acoustically engineered to provide a defined and intentional acoustic resistance or filtering effect. For example, duct mesh may be a mesh or foam material that is manufactured to filter certain sound pressure waves emitted by driver 202 toward duct port 612 through bass duct 606. Alternatively, duct mesh may be acoustically transparent so as to not substantially interfere with sound transmission through duct port 612 any more than is already inherent in the duct port 612 geometry. In either case, duct mesh may provide a protective barrier against the unwanted entry of external materials, such as dust, water, or other particles, into bass duct 606 from vent chamber 610.

In an embodiment, vent port 402 may be formed through rear wall 108 between vent chamber 610 and a surrounding environment. The surrounding environment may be the ambient environment or the environment outside of earphone 100. For example, sound may propagate through vent port 402 from vent chamber 610 to a space within a user's outer ear or into a room within which the user is listening to the earphone 100. Accordingly, the vent chamber 610 may be acoustically coupled with the surrounding environment through vent port 402. As described above, vent port 402 may be the sole acoustic opening in rear wall 108 through which any rearward sound leaving housing 104 passes. Similarly, vent port 402 may form a sole visual opening in rear wall 108. That is, earphone 100 may include only a single opening in rear wall 108 behind outer edge 504 that is visually discernible to a user.

A vent mesh 518 may be disposed over or within vent port 402 to modify the surface area through which sound transmits between vent chamber 610 and the surrounding environment. For example, vent mesh 518 may be an acoustically transparent material, meaning that it does not affect an acoustic performance of earphone 100. Alternatively, vent mesh 518 may modify the acoustic performance of earphone 100, by altering acoustic impedance of vent port 402. For example, the vent mesh 518 material may be acoustically engineered to provide a defined and intentional acoustic resistance or filtering effect, e.g., to filter certain sound pressure waves emitted by driver 202 toward vent port 402 through back volume 604, bass duct 606, and vent chamber 610. In either case, vent mesh 518 may provide a protective barrier against the unwanted entry of external materials, such as dust, water, or other particles, into housing 104 from the surrounding environment.

Figure 7:
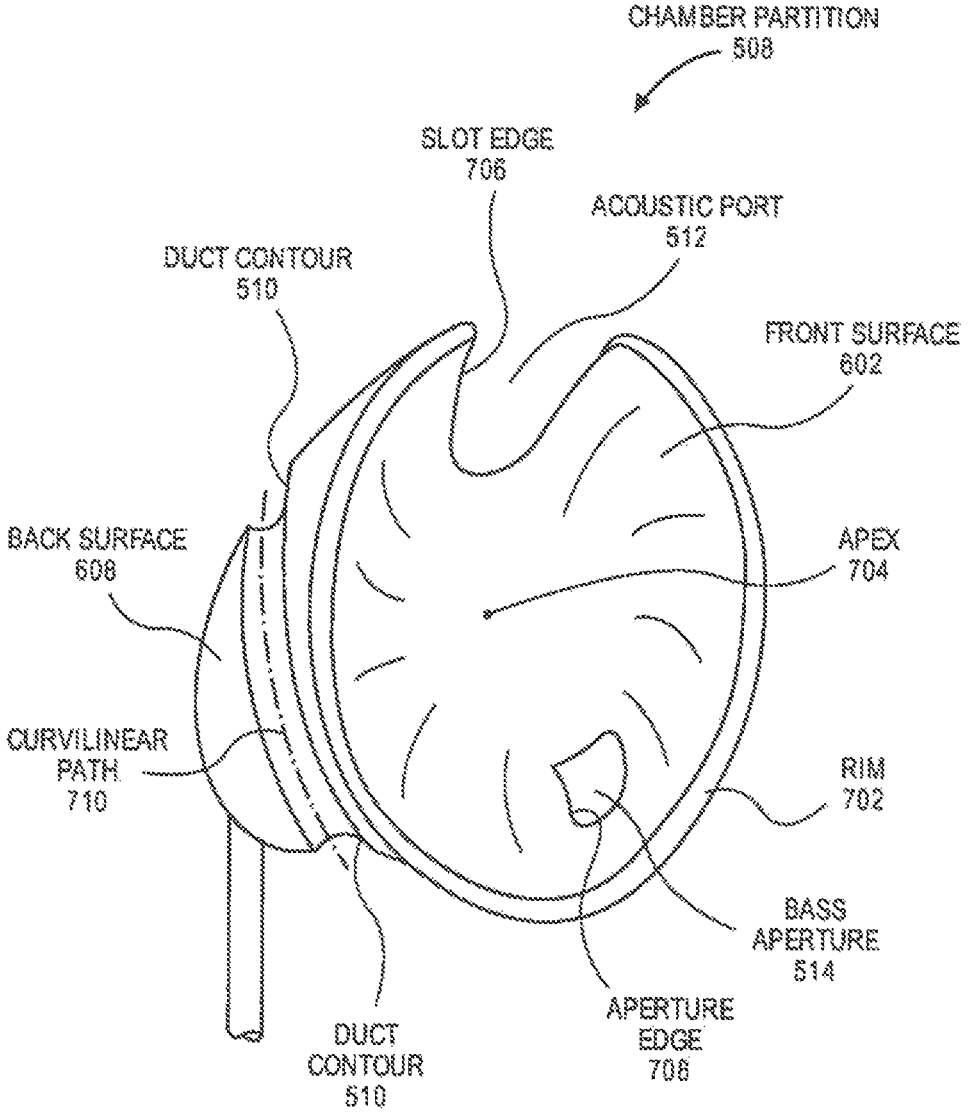
FIG. 7 is a front perspective view of a chamber partition in accordance with an embodiment of the invention.

Referring to FIG. 7, a front perspective view of a chamber partition is shown in accordance with an embodiment of the invention. As described above, chamber partition 508 may include any geometry that fits within the rear space between driver 202 and rear wall 108, and which subdivides the rear space into an acoustic network. Accordingly, chamber partition 508 may include front surface 602 facing driver 202 and at least partially defining back volume 604. As such, front surface 602 may include a concave shape extending from a rim 702 to an apex 704 near earphone axis 502. For example, front surface 602 may include a conical surface with a base perimeter around rim 702 and a locus at apex 704. Alternatively, front surface 602 may include a quadric surface, such as a paraboloid surface extending from rim 702 to apex 704. Rim 702 may seal against an inner surface of rear wall 108, e.g., by an adhesive bond or a press fit between rim 702 and rear wall 108. Thus, front surface 602 may define a portion of back volume 604 having a conforming convex surface. Although front surface 602 may have a cone shape, it may similarly be shaped as a semi-spherical surface, a cubical surface, a pyramidal surface, etc. Furthermore, front surface 602 need not be concave, e.g., it may be convex or flat. Thus, front surface 602 may have any shape that defines a back volume 604 that imparts desirable acoustic performance to earphone 100.

One or more port or aperture may be formed through chamber partition 508, e.g., from front surface 602 to back surface 608. A port or an aperture may be an acoustically calibrated opening or pathway that enhances an acoustic performance of earphone 100. Ports or apertures within earphone 100 may be any shape, including tear-shaped, circular, elliptical, semi-circular, polygonal, etc. It will be appreciated that in some embodiments, any opening through chamber partition 508 may have an entrance and exit fully defined within rim 702 of front surface 602, as shown for bass aperture 514, or may have an entrance or exit defined by the combination of chamber partition 508 and another surface such as rear wall 108, as shown for acoustic port 512. Thus, openings connecting the various chambers and ducts within earphone 100 are not intended to be limited exclusively to the geometries shown in the figures.

In an embodiment, acoustic port 512 may be a slot extending from rim 702 along a slot edge 706 to form a saddle-shaped opening in the direction of earphone axis 502. As mentioned above, rim 702 may seal against an inner surface of rear wall 108 such that an enclosed opening is provided for sound emitted by driver 202 to pass from back volume 604 on a front side of chamber partition 508 to vent chamber 610 on a back side of chamber partition 508.

Chamber partition 508 may also include an aperture formed through a wall of chamber partition 508 from front surface 602 to back surface 608. For example, bass aperture 514 may include a hole through chamber partition 508 at a location that is spaced apart from acoustic port 512 across back volume 604 and/or along front surface 602. That is, acoustic port 512 and bass aperture 514 may be separated along chamber partition 508 so as to receive and transmit different portions of sound emitted by driver 202. Unlike acoustic port 512, bass aperture 514 may be defined between an aperture edge 708 that is fully within rim 702 of front surface 602, i.e., bass aperture 514 may be an opening, bore, or hole through chamber partition 508, rather than an opening defined by the combination of rear wall 108 and slot edge 706.

Duct contour 510 may essentially form a cross-sectional profile of bass duct 606. That is, duct contour 510 may be a recessed profile in back surface 608, which extends over a path, such as a straight path or curvilinear path 710, to form a groove traversing a distance along back surface 608. Thus, when duct contour 510 is a semi-circular recess in back surface 608, the groove along back surface 608 may have a semi-cylindrical volume over a straight or curvilinear length. Furthermore, bass duct 606 may be defined between the groove and a mating portion of rear wall 108. Thus, bass duct 606 may enclose a volume of air, e.g., a semi-cylindrical volume of air, which acts as an acoustic mass.

Figure 8:
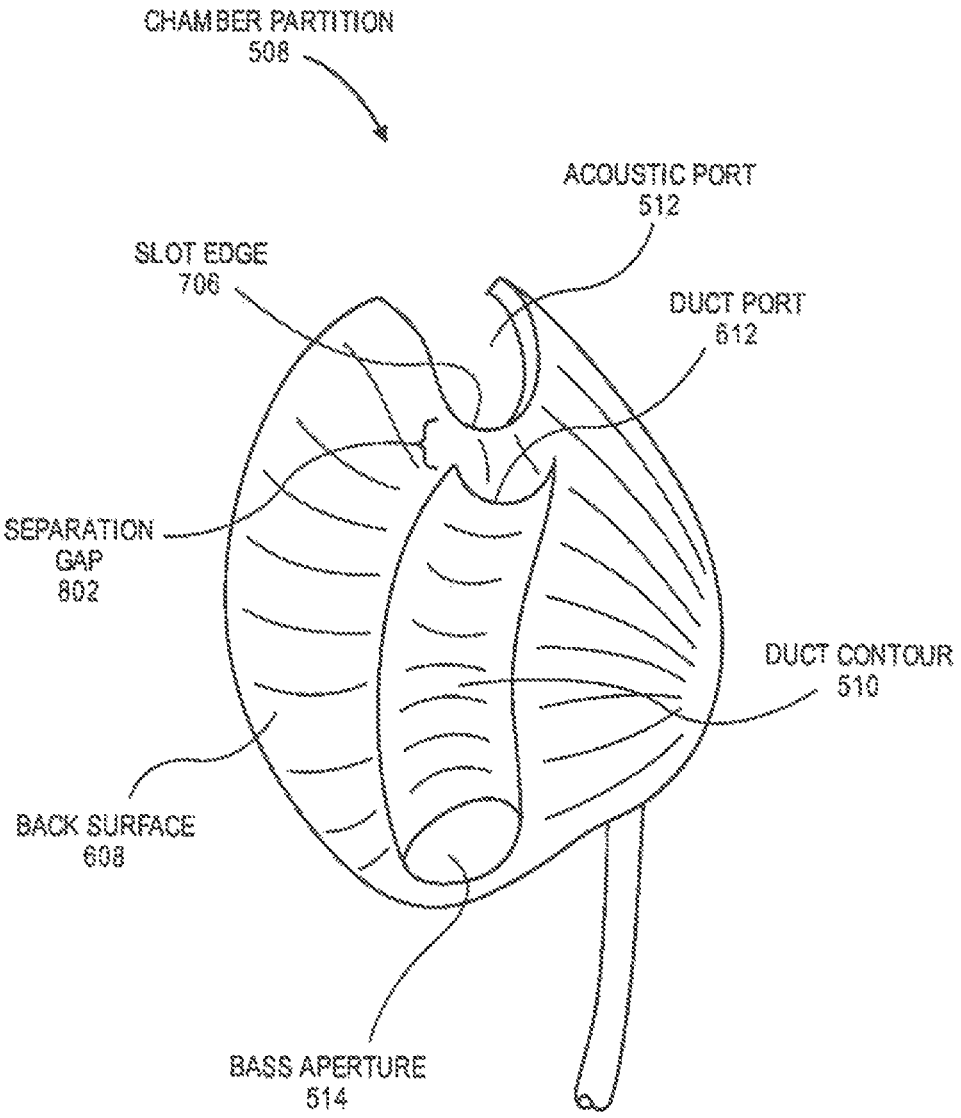
FIG. 8 is a rear perspective view of a chamber partition in accordance with an embodiment of the invention.

Referring to FIG. 8, a rear perspective view of a chamber partition 508 is shown in accordance with an embodiment of the invention. Duct contour 510 may extend along a straight or curved length, e.g., along curvilinear path 710, between a starting point at bass aperture 514 and an ending point at duct port 612. More particularly, when back surface 608 mates with an apposing surface, such as rear wall 108, the acoustic mass of bass duct 606 may become enclosed between rear wall 108 and back surface 608 within housing 104. Accordingly, bass duct 606 may extend from an entrance at bass aperture 514 to an exit at duct port 612.

Acoustic port 512 through chamber partition and duct port 612 between chamber partition 508 and rear wall 108 may be located at vent chamber 610, as described above. More particularly, sound may be emitted through both acoustic port 512 and duct port 612 into vent chamber 610 of an assembled earphone 100. In an embodiment, the sound passing through acoustic port 512 and duct port 612 may enter vent chamber 610 near the same location. For example, slot edge 706 partly defining acoustic port 512 and duct contour 510 partly defining duct port 612 may be separated across vent chamber 610, or along back surface 608 of chamber partition 508, by a separation gap 802. In an embodiment, separation gap 802 is less than the length of bass duct 606. In an embodiment, separation gap 802 is less than about 10 mm. For example, separation gap 802 may be less than 1 mm, e.g., approximately 0.1 mm. Accordingly, sound emitted by driver 202 into back volume 604 may divide and propagate through both acoustic port 512 and duct port 612 before meeting in vent chamber 610 and exhausting to the surrounding environment through vent port 402.

Figure 9:
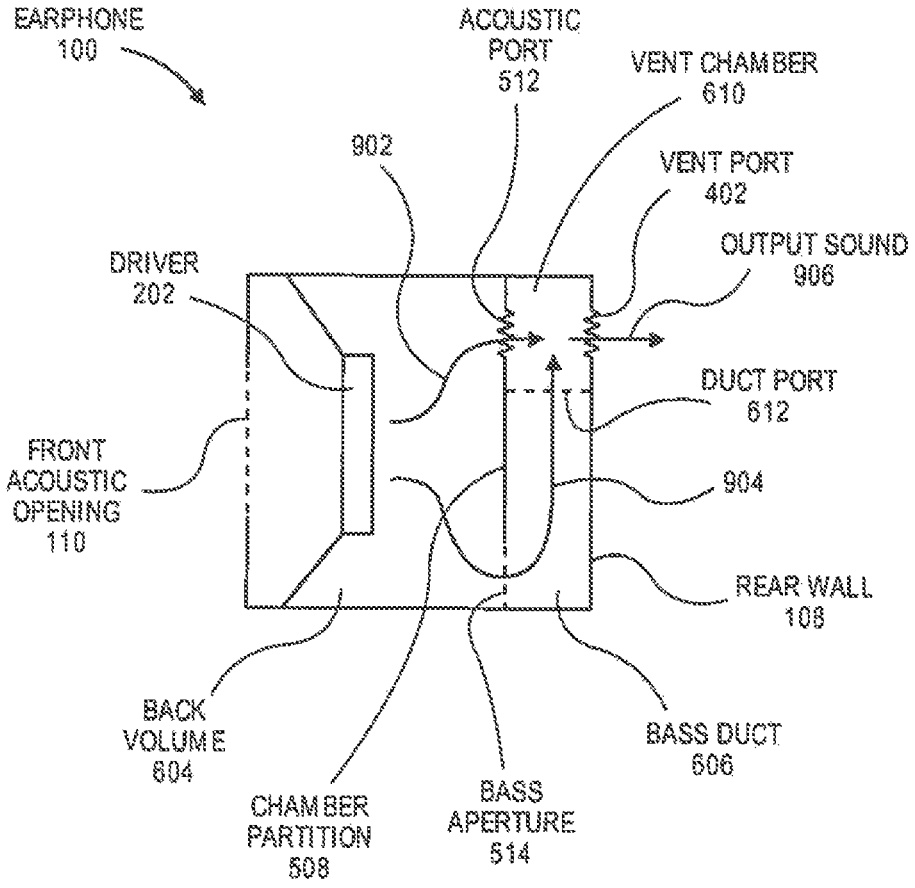
FIG. 9 is a schematic view of an earphone having a single acoustic opening in a rear portion of a housing in accordance with an embodiment of the invention.

Referring to FIG. 9, a schematic view of an earphone having a single acoustic opening in a rear portion of a housing is shown in accordance with an embodiment of the invention. The schematic view aids in visualizing sound paths through earphone 100. Earphone 100 may include driver 202 with a front face directed toward front acoustic opening 110 such that sound emitted by driver 202 propagates forward into an ear canal. Driver 202 may also emit sound in a rearward direction toward back volume 604, and for purposes of illustration, sound may be described as splitting into a first sound portion 902 and a second sound portion 904. First sound portion 902 may propagate through acoustic port 512 in chamber partition 508 to enter into vent chamber 610. Second sound portion 904 may propagate through bass aperture 514 in chamber partition 508 and bass duct 606 along back surface 608 before entering vent chamber 610. Thus, first sound portion 902 and second sound portion 904 may enter, meet, or mix within vent chamber 610 after leaving back volume 604 through respective ports or apertures. More particularly, first sound portion 902 and second sound portion 904 may enter a same vent chamber 610, before discharging to the surrounding environment. Accordingly, first sound portion 902 and second sound portion 904 may propagate in separate directions from driver 202 and then mix at a same location within vent chamber 610 to combine into an output sound 906 that is vented from earphone 100 through vent port 402.

Figure 10:
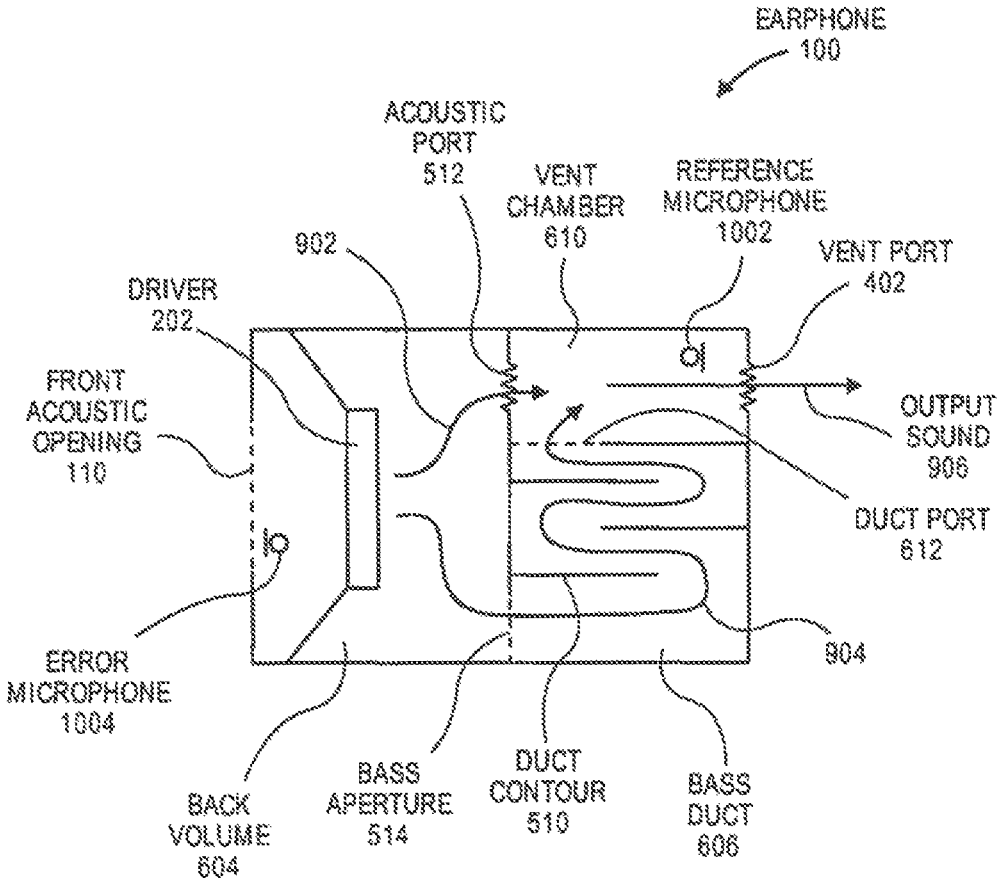
FIG. 10 is a schematic view of an earphone having a single acoustic opening in a rear portion of a housing in accordance with an embodiment of the invention.

Referring to FIG. 10, a schematic view of an earphone having a single acoustic opening in a rear portion of a housing is shown in accordance with an embodiment of the invention. The schematic view aids in visualizing one manner that first sound portion 902 or second sound portion 904 may follow a tortuous path between back volume 604 and vent chamber 610. However, sound propagating through earphone 100 may follow a tortuous path along any segment of the acoustic network, e.g., even from vent chamber 610 to the surrounding environment. As described above, first sound portion 902 may be emitted by driver 202 through acoustic port 512 into vent chamber 610. Similarly, second sound portion 904 may be emitted by driver 202 toward bass aperture 514. Second sound portion 904 may propagate from bass aperture 514 through bass duct 606 toward duct port 612 to enter vent chamber 610. In an embodiment, bass duct 606 is defined by duct contour 510 that follows curvilinear path 710 along back surface 608. For example, curvilinear path 710 may be a tortuous path having a number of bends which may be 90 degrees or more. A tortuous path may also include a single bend or curve that extends over a total path length that is at least three times the linear distance between bass aperture 514 and duct port 612. For example, bass duct 606 may spiral around earphone axis 502 along back surface 608 from bass aperture 514 to an adjacent duct port 612. That is, the spiral may be along path 710. First sound portion 902 and second sound portion 904 may meet within vent chamber 610 and combine into output sound 906 that is subsequently discharged to the surrounding environment through vent port 402.

As described above the acoustic ports, apertures, and ducts may be dimensioned to tune an acoustic performance of earphone 100. Furthermore, additional components, such as meshes placed over the ports and apertures, may be used to tune acoustic performance. One skilled in the art may introduce additional components to further alter acoustic response, such as by implementing baffles or other acoustic materials along surfaces, or suspended within ducts or chambers, of the acoustic network. Such additional components may further alter sound propagation through earphone 100. Thus, the ports, apertures, ducts, and chambers within earphone 100 are calibrated in the sense that they have been tested or evaluated, in at least one specimen of a manufactured lot, for compliance with a given specification or design parameter. In other words, the acoustic network of earphone 100 is not made of random openings and grooves, but is intentionally formed to modify the acoustic performance of the earphone 100 in a way that tunes the resonance, frequency response, and bass response of earphone 100. The acoustic tuning parameters may be tuned through variation of the structures described above. Some of these parameters shall now be addressed, although it is to be understood that the following discussion of particular acoustic characteristics may be altered within the scope of this description and is therefore not intended to be limiting of the invention.

In an embodiment, each aperture and port of earphone 100 may include a particular acoustic impedance. Acoustic impedance affects how sound propagates through an acoustic medium, e.g., air, and thus, is useful as a tuning parameter to affect, e.g., tuning of a resonance frequency of earphone 100. Acoustic impedance may be determined based on a geometry and material of a port or aperture, as well as by a geometry and material of another component occluding a portion of the port of aperture, e.g., acoustic mesh 516 or vent mesh 518. Accordingly acoustic impedance of an aperture or port may be tuned as desired.

In an embodiment, an acoustic impedance of acoustic port 512 and/or acoustic mesh 516 over acoustic port 512 is tuned to be higher than an acoustic impedance of vent port 402 and/or vent mesh 518 over vent port 402. For example, acoustic port 512 may have a smaller diameter than vent port 402, or acoustic mesh 516 may have a higher mesh surface area to port cross-sectional area ratio, e.g., a higher packing density, than vent port 402. Accordingly, sound propagation through back volume 604 may be resisted more than sound propagation through vent port 402, such that sound entering vent chamber 610 discharges freely into the surrounding environment. In an embodiment, the acoustic impedance of acoustic port 512 and/or acoustic mesh 516 may be at least 25 times more than an acoustic impedance of vent port 402 and/or vent mesh 518. For example, the acoustic impedance of acoustic port 512 and/or acoustic mesh 516 may be 50 to 100 times the acoustic impedance of vent port 402 and/or vent mesh 518.

The acoustic impedance of other ports and apertures within earphone 100 may be similarly tuned. For example, duct port 612 and or a duct mesh over duct port 612 may also have an acoustic impedance, and in an embodiment, the acoustic impedance of duct port 612 and/or the duct mesh may be tuned to be higher than the acoustic impedance of vent port 402 and/or vent mesh 518. By contrast, the acoustic impedance of duct port 612 and/or duct mesh may be tuned to be lower than the acoustic impedance of acoustic port 512 and/or acoustic mesh 516.

Each chamber or volume within earphone 100 may also include an acoustic impedance. For example, bass duct 606 may have an acoustic impedance that is based on an acoustic mass of the bass duct 606 as well as acoustic losses, e.g., viscous and thermal losses, which occur when sound passes through bass duct 606. As described above, bass duct 606 may encompass a volume of air that acts as the acoustic mass. The acoustic mass may be conceptualized as mass that is added to diaphragm 506 of driver 202. Thus, the acoustic mass may be sized, based on the geometry of bass duct 606, to affect the resonance and bass response of driver 202. For example, the higher the acoustic mass of bass duct 606, the lower the resonance and the more bass of earphone 100. However, the size of the acoustic mass of bass duct 606 may be limited in that driver 202 must be large enough to drive the acoustic mass, and thus, cost and packaging size considerations may impose practical limitations on driver selection. Once an appropriate acoustic mass is selected to create the desired resonance and bass response for a practical driver 202, the geometry of bass duct 606 may be optimized to fit within the available rear space. For example, to peg the acoustic mass at a desired value, as bass duct 606 length is shortened to fit behind chamber partition 508, so must duct contour 510 area be decreased. However, the reduction in bass duct 606 size becomes limited by viscous and thermal losses, which roughly increase proportional to the inverse square of the duct contour 510 area, thereby increasing acoustic impedance of bass duct 606. Therefore, a trade-off between duct size, and hence earphone size, and acoustic performance of bass duct 606 may exist. In an embodiment, bass duct 606 may be sized such that the acoustic losses through bass duct 606 are about twice the acoustic losses through vent port 402. This may provide for a compact earphone with desirable bass response. Accordingly, an acoustic impedance of bass duct 606 may be greater than an acoustic impedance of vent port 402 and/or vent mesh 518 covering vent port 402. In an embodiment, respective acoustic impedances of bass duct 606, vent port 402, and/or vent mesh 518 may be minimized to approximate zero as closely as possible and to remain less than the acoustic impedance of acoustic port 512 or acoustic mesh 516.

Even in a case in which an acoustic impedance of a port, aperture, or volume is minimized, the acoustic impedance may nonetheless be greater than zero to achieve aesthetic or other functional purposes. For example, a mesh may cover a port to provide a visual distinctiveness to the port for aesthetic reasons, and thus, even if a mesh is used having a small mesh surface area to port cross-sectional surface area, e.g., less than about 75%, the acoustic impedance of the port may be greater than zero. Similar shrouding of ports may be used for the functional purpose of reducing the likelihood that external particles will enter the earphone rear space. For example, as described above, vent port 402 and/or vent mesh 518 may be essentially acoustically transparent. For example, the acoustic impedance of vent port 402 and/or vent mesh 518 may be on the order of about 10 Rayl, or less. More particularly, vent mesh 518 over vent port 402 may have a plurality of openings that are sized to resist ingress of dust, debris, sand, or other particles, but to provide minimal resistance to sound. The plurality of openings may have effective diameters of about 300 micron or less. For example, the plurality of openings may have effective diameters of about 200 micron, making them small enough to resist ingress of most sand particles, but having an acoustic impedance that approximates zero relative to the acoustic impedance of ambient air. In an embodiment, vent port 402 may be uncovered and ingress of particles into back volume 604 and bass duct 606 may be resisted by acoustic mesh 516 over acoustic port 512 and/or a duct mesh over duct port 612. In another embodiment, bass duct 606 may not include a duct mesh, but may be tortuous such that particles that that enter duct port 612 through vent chamber 610 may be unlikely to migrate all the way to back volume 604 through bass aperture 514. Thus, both vent port 402 and duct port 612 may be uncovered, open channels. Accordingly, it will be appreciated that ports and apertures of earphone 100 may be covered or uncovered to create the desired acoustic impedance and to reduce the likelihood of particles entering back volume 604.

Still referring to FIG. 10, in an embodiment, earphone may incorporate active noise control elements such as microphones, analog circuits, or digital signal processing components to reduce unwanted environmental noise. More particularly, an ambient or reference microphone 1002 may be located in vent chamber 610 facing vent port 402 and/or the surrounding environment. Reference microphone 1002 may receive external sounds from the surrounding environment and convert the sounds into an electrical signal that is provided to signal processing circuitry, which may by internal or external to earphone 100. Signal processing circuitry may use adaptive algorithms to analyze a waveform of the ambient sound and either phase shift or invert the waveform to create a cancellation signal. The cancellation signal may then be provided to driver 202, or to an additional speaker housed in earphone 100, to produce a cancellation sound that will destructively interfere with the ambient sound as it travels toward the ear canal. The volume of the perceivable ambient noise may be reduced accordingly. Furthermore, an error microphone 1004 may be included in earphone 100, e.g., within or external to front wall 106, and may be directed toward the user's ear. The error microphone 1004 may sense sound and return a feedback signal to the signal processing circuitry that may make additional adjustments to the noise cancellation signal based on a determination of how well the ambient noise is being cancelled, or in view of other sound quality characteristics determined from the feedback signal.

In an embodiment, one or both of reference microphone 1002 or error microphone 1004 may be used in a telephony application. More particularly, earphone 100 may include a microphone, e.g., reference microphone 1002, which may be located inside or outside of housing 104 to act as a voice pick up to receive a user's speech. The received sound may be converted by the microphone to an electrical signal for further processing in a telephony use case.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An earphone, comprising:

a housing including a sole acoustic port in a rear wall;

a driver within the housing, wherein the rear wall encloses a rear space behind the driver in a direction of an earphone axis, and wherein the driver emits sound that leaves the rear space through the sole acoustic port; and a partition including an outer rim having a slot edge to define an opening radially, relative to the earphone axis, between the slot edge and an inner surface of the rear wall, and wherein the partition is located in the rear space to divide the rear space into a plurality of volumes including a bass duct extending along a curved path.

2. The earphone of claim 1, wherein the curved path extends along the rear wall.

3. The earphone of claim 1, wherein the plurality of volumes include a back volume between the driver and the partition, and wherein the partition includes a plurality of ports facing the back volume.

4. The earphone of claim 3, wherein the bass duct routes the sound from the back volume to the sole acoustic port.

5. The earphone of claim 3, wherein the plurality of volumes include a vent chamber connected to the sole acoustic port, and wherein the bass duct encloses a volume of air between a bass aperture at the back volume and a duct port at the vent chamber.

6. The earphone of claim 5, wherein the bass aperture is one of the plurality of ports facing the back volume.

7. The earphone of claim 1, wherein the sole acoustic port is a sole externally visible opening in the rear wall.

8. An earphone, comprising:

a housing including a sole acoustic port in a rear wall;

a driver within the housing, wherein the rear wall encloses a rear space behind the driver in a direction of an earphone axis, and wherein the driver emits sound that leaves the rear space through the sole acoustic port; and a partition including an outer rim having a slot edge to define an opening radially, relative to the earphone axis, between the slot edge and an inner surface of the rear wall, and wherein the partition is located in the rear space to divide the rear space into a plurality of volumes including a bass duct extending along the rear wall.

9. The earphone of claim 8, wherein the bass duct routes the sound to the sole acoustic port along a curved path.

10. The earphone of claim 9, wherein the curved path extends about an earphone axis.

11. The earphone of claim 8, wherein the plurality of volumes include a back volume between the driver and the partition, and wherein the partition includes a plurality of ports facing the back volume.

12. The earphone of claim 11, wherein the plurality of volumes include a vent chamber connected to the sole acoustic port, and wherein the bass duct encloses a volume of air between a bass aperture at the back volume and a duct port at the vent chamber.

13. The intra-concha earphone of claim 12, wherein the bass aperture is one of the plurality of ports facing the back volume.

14. The intra-concha earphone of claim 8, wherein the sole acoustic port is a sole externally visible opening in the rear wall.

15. An intra-concha earphone, comprising:

a housing including a sole acoustic port in a rear wall;

a driver within the housing, wherein the rear wall encloses a rear space behind the driver in a direction of the earphone axis, and wherein the driver emits sound that leaves the rear space through the sole acoustic port; and a partition including an outer rim having a slot edge to define an opening radially, relative to the earphone axis, between the slot edge and an inner surface of the rear wall, and wherein the partition is located in the rear space to divide the rear space into a plurality of volumes including a back volume between the driver and the partition, wherein the partition includes a plurality of ports facing the back volume.

16. The earphone of claim 15, wherein the plurality of volumes include a bass duct, and wherein the bass duct extends along a curved path.

17. The earphone of claim 16, wherein the curved path extends along the rear wall.

18. The earphone of claim 16, wherein the plurality of volumes include a vent chamber connected to the sole acoustic port, and wherein the bass duct encloses a volume of air between a bass aperture at the back volume and a duct port at the vent chamber.

19. The earphone of claim 15, wherein the plurality of ports includes a port defined between the outer edge of the partition and the rear wall.

20. The earphone of claim 15, wherein the sole acoustic port is a sole externally visible opening in the rear wall.

* * * * *